US008186172B2

(12) United States Patent
Inoue et al.

(10) Patent No.: US 8,186,172 B2
(45) Date of Patent: May 29, 2012

(54) STRUCTURE FOR SENSING REFRIGERANT FLOW RATE IN A COMPRESSOR

(75) Inventors: Yoshinori Inoue, Kariya (JP); Hirokazu Mesaki, Kariya (JP); Atsuhiro Suzuki, Kariya (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 1012 days.

(21) Appl. No.: 11/894,320

(22) Filed: Aug. 20, 2007

(65) Prior Publication Data

US 2008/0041080 A1 Feb. 21, 2008

(30) Foreign Application Priority Data

Aug. 21, 2006 (JP) ..... 2006-224204

(51) Int. Cl.
*F25B 49/00* (2006.01)

(52) U.S. Cl. ..... 62/228.3; 62/228.5

(58) Field of Classification Search ..... 62/228.3, 62/228.5; 417/213, 222.1, 222.2, 269, 270, 417/279; 92/13
See application file for complete search history.

(56) References Cited

U.S. PATENT DOCUMENTS

| | | | | |
|---|---|---|---|---|
| 4,646,624 | A * | 3/1987 | Stearns | 92/37 |
| 5,086,655 | A | 2/1992 | Fredericks et al. | |
| 5,284,053 | A * | 2/1994 | Wadlow et al. | 73/199 |
| 6,263,687 | B1 * | 7/2001 | Ban et al. | 62/228.3 |
| 6,302,656 | B1 | 10/2001 | Hirota | |
| 6,425,254 | B1 * | 7/2002 | Ota et al. | 62/133 |
| 6,662,582 | B2 * | 12/2003 | Hirota et al. | 62/228.3 |
| 6,804,970 | B2 * | 10/2004 | Saeki et al. | 62/133 |
| 7,523,620 | B2 * | 4/2009 | Umemura et al. | 62/228.3 |
| 2003/0024257 | A1 * | 2/2003 | Hirota et al. | 62/228.3 |
| 2006/0039798 | A1 * | 2/2006 | Yoshihiro | 417/222.2 |
| 2008/0063540 | A1 * | 3/2008 | Inoue et al. | 417/222.2 |
| 2008/0104984 | A1 * | 5/2008 | Kanai et al. | 62/228.3 |
| 2008/0110188 | A1 * | 5/2008 | Inoue et al. | 62/228.3 |

FOREIGN PATENT DOCUMENTS

| | | | |
|---|---|---|---|
| DE | 0 219 489 | A1 | 4/1987 |
| EP | 0 992 684 | A2 | 4/2000 |
| JP | 60-209116 | | 10/1985 |

(Continued)

OTHER PUBLICATIONS

European Search Report dated Dec. 28, 2007 issued by European Patent Office for application No. 07114595.7-2315.

(Continued)

*Primary Examiner* — George Nguyen
(74) *Attorney, Agent, or Firm* — Locke Lord LLP

(57) ABSTRACT

A structure for sensing refrigerant flow rate in a compressor. The structure includes a passage forming member, a restriction hole, a differential pressure-type flow rate sensor, and a partition plate. The compressor includes a housing connected to an external refrigerant circuit via a refrigerant passage. The passage forming member is connected to an outer surface of the housing and forms a part of the refrigerant passage. The restriction hole divides the refrigerant passage into an upstream passage and a downstream passage. The upstream passage is formed in either the housing or the passage forming member. The sensor is provided in the passage forming member and detects pressure in the upstream passage and pressure in the downstream passage to sense flow rate of refrigerant in the refrigerant passage. The partition plate is disposed between the housing and the passage forming member. The restriction hole is formed in the partition plate to extend through the partition plate.

8 Claims, 5 Drawing Sheets

FOREIGN PATENT DOCUMENTS

| | | | | |
|---|---|---|---|---|
| JP | 63-177715 | | | 11/1988 |
| JP | 01253574 | A | * | 10/1989 |
| JP | 4-353210 | | | 12/1992 |
| JP | 2004-012394 | | | 1/2004 |
| JP | 2004-197679 | | | 7/2004 |

OTHER PUBLICATIONS

U.S. Appl. No. 11/800,892, filed May 7, 2007, Masaki Ota et al.

* cited by examiner

STRUCTURE FOR SENSING REFRIGERANT FLOW RATE IN A COMPRESSOR

CROSS-REFERENCE TO RELATED APPLICATION

This application is based upon and claims the benefit of priority from prior Japanese Patent Application No. 2006-224204, filed on Aug. 21, 2006, the entire content of which is incorporated herein by reference.

FIELD OF THE INVENTION

The present invention relates to a structure for sensing flow rate of refrigerant in a compressor.

BACKGROUND

Japanese Unexamined Patent Publication No. 2004-197679 discloses a variable displacement compressor in which the opening degree of a displacement control valve provided in the housing of the compressor is controlled by determining whether an appropriate flow rate of refrigerant is produced in the refrigerant circuit. The opening degree of the displacement control valve may be varied by differential pressure acting on both sides of a restriction hole provided in a passage for discharging refrigerant. In this valve, differential pressure and electromagnetic force caused by supplying current to a solenoid in the valve counteract each other via the valve body. The opening degree of the valve is determined by the location of the valve body that is balanced by the counteraction.

In the above displacement control valve, the greater the flow rate of refrigerant in the refrigerant circuit, the greater the differential pressure on both sides of the restriction hole. As the differential pressure increases, the opening degree of the valve increases. When the flow rate of refrigerant exceeds an appropriate rate, the opening degree of the valve becomes larger and more refrigerant is supplied to a crank chamber from a discharge chamber through a valve hole. Thus, the increased pressure in the crank chamber decreases the inclination of a swash plate so that the flow rate of refrigerant is decreased to converge on an appropriate rate. When the flow rate of refrigerant is reduced to less than an appropriate rate, the opening degree of the valve becomes smaller and less refrigerant is supplied to the crank chamber from the discharge chamber through the valve hole. Thus, the decreased pressure in the crank chamber increases the inclination of the swash plate so that the flow rate of refrigerant is increased to converge on an appropriate rate.

When the compressor is provided with driving force from a vehicle engine, output control of the engine is necessary so that the engine output results in appropriate compressor torque. Since the flow rate of refrigerant reflects the torque of the compressor, the torque of the compressor can be estimated by detecting the flow rate of refrigerant. Although the differential pressure on both sides of the restriction hole reflects the flow rate of refrigerant, the flow rate of refrigerant is not directly detected. Accordingly, the flow rate of refrigerant, or the torque of the compressor, is estimated based on the magnitude of the current that is provided to the solenoid.

When the compressor is started, operation control to set the displacement of the compressor at 100% is performed. When the compressor starts working, liquid refrigerant that had remained in the crank chamber when the compressor stopped begins to evaporate. Then the pressure in the crank chamber is increased and the compressor continues working with the inclination angle of its swash plate remaining small. In other words, the flow rate of refrigerant is low. Meanwhile, the estimated flow rate of refrigerant based on the current supplied to the solenoid is greater. Accordingly, operation of the vehicle engine is controlled on the basis that compressor torque is great in spite of the fact that the actual torque of the compressor is small. This bring energy loss.

To address this, it is desirable to detect the flow rate of refrigerant in the variable displacement compressor by using a differential pressure-type flow rate sensor as disclosed in Japanese Unexamined Patent Publication No. 2004-12394. This sensor outputs an electrical signal based on differential pressure acting on both sides of a restriction hole provided in a passage for discharging refrigerant. The location of the sensor is not in the housing of the compressor but preferably in a passage forming member that forms a part of the passage for discharging refrigerant and that is detachably connected to the compressor housing. Thus, the sensor can be adjusted or corrected while the passage forming member is detached from the compressor housing. This makes adjustment and correction of the sensor easier than in a case where the sensor is located in the compressor housing.

The size of the restriction hole (or the cross-sectional area of the passage or the length of the hole) is an important factor for obtaining an appropriate differential pressure. However, when the restriction hole is provided in the housing or the passage forming member, to form a restriction hole having a desired size (or a desired cross-sectional area of the passage or a desired length of the hole) with high accuracy is difficult.

SUMMARY

An object of the present invention is to provide a structure for sensing flow rate of refrigerant in which a differential pressure-type flow rate sensor is provided in the passage forming member connected to an outer surface of the compressor and a restriction hole is formed with high accuracy in the refrigerant passage for generating differential pressure.

According to one aspect of the invention, a structure for sensing flow rate of refrigerant in a compressor including a passage forming member, a restriction hole, a differential pressure-type flow rate sensor, and a partition plate is provided. The compressor includes a housing connected to an external refrigerant circuit via a refrigerant passage. The passage forming member is connected to an outer surface of the housing and forms a part of the refrigerant passage. The restriction hole divides the refrigerant passage into an upstream passage and a downstream passage. The upstream passage is formed in either the housing or the passage forming member. The sensor is provided in the passage forming member and picks up a pressure in the upstream passage and a pressure in the downstream passage to sense flow rate of refrigerant in the refrigerant passage. The partition plate is disposed between the housing and the passage forming member. The restriction hole is formed in the partition plate to extend through the partition plate.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A first embodiment of a structure for sensing flow rate of refrigerant according to the present invention is described with reference to FIGS. 1 to 6.

Figure 1:
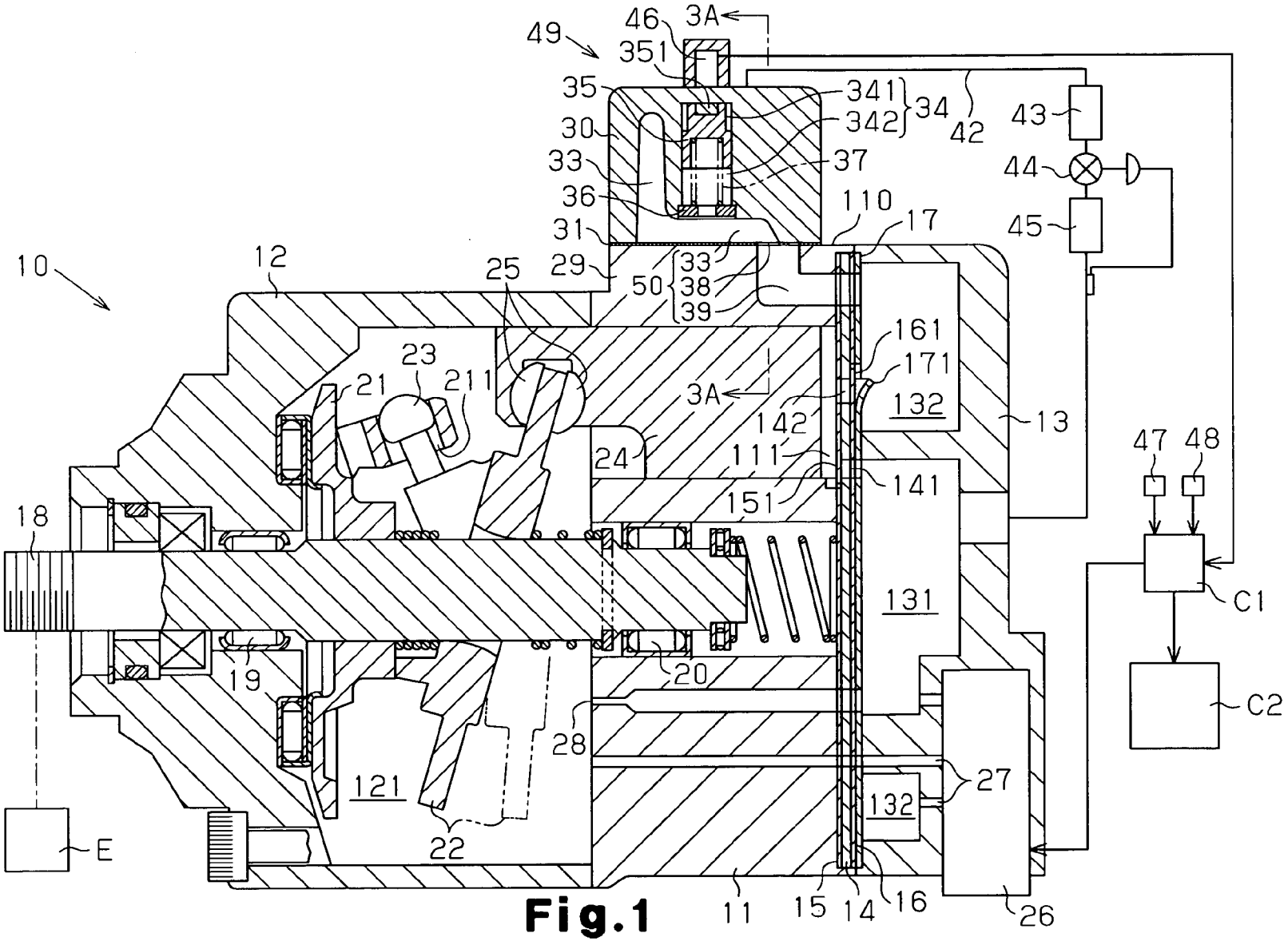
FIG. 1 is a cross-sectional side view of an entire variable displacement compressor illustration a first embodiment of a structure for sensing flow rate of refrigerant according to the present invention.

As shown in FIG. 1, a front housing member 12 is secured to the front end of a cylinder block 11. A rear housing member 13 is secured to the rear end of the cylinder block 11 with a valve plate 14, valve flap plates 15, 16, and a retainer plate 17 arranged in between. The cylinder block 11, the front housing member 12, and the rear housing member 13 form a housing of a variable displacement compressor 10.

The cylinder block 11 and the front housing member 12 define a control pressure chamber 121. The front housing member 12 and the cylinder block 11 rotatably support a rotary shaft 18 with radial bearings 19, 20. The rotary shaft 18 projects from the control pressure chamber 121 to the outside, and receives power from a vehicle engine E, which is an external power source.

A rotary support 21 is fixed to the rotary shaft 18, and a swash plate 22 is supported on the rotary shaft 18. The swash plate 22 is permitted to incline with respect to and slide along an axial direction of the rotary shaft 18. A pair of guide holes 211 are formed in the rotary support 21, and a pair of guide pins 23 are formed on the swash plate 22. The guide pins 23 are slidably fitted in the guide holes 211. The engagement of the guide pins 23 with the guide holes 211 allows the swash plate 22 to be tiltable with respect to the axial direction of the rotary shaft 18 and rotatable together with the rotary shaft 18. The guide holes 211 slidably guide the guide pins 23, and the rotary shaft 18 slidably supports the swash plate 22. These actions permit the swash plate 22 to be inclined.

When the center of the swash plate 22 moves toward the rotary support 21, the inclination of the swash plate 22 increases. When contacting the swash plate 22, the rotary support 21 determines the maximum inclination of the swash plate 22. When in a position indicated by solid line in FIG. 1, the swash plate 22 is at the maximum inclination position. When in a position indicated by chain line, the swash plate 22 is at the minimum inclination position.

A plurality of cylinder bores 111 extend through the cylinder block 11. Each cylinder bore 111 accommodates a piston 24. The rotation of the swash plate 22 is converted to reciprocation of the pistons 24 by means of shoes 25. Thus, each piston 24 reciprocates in the corresponding cylinder bore 111.

A suction chamber 131 and a discharge chamber 132 are defined in the rear housing member 13. The suction chamber 131 forms a suction pressure zone and the discharge chamber 132 forms a discharge pressure zone. Suction ports 141 are formed in a valve plate 14, a valve flap plate 16, and a retainer plate 17. Discharge ports 142 are formed in the valve plate 14 and a valve flap plate 15. Suction valve flaps 151 are formed on the valve flap plate 15, and discharge valve flaps 161 are formed on the valve flap plate 16. As each piston 24 moves from the top dead center to the bottom dead center (from the right side to the left side in FIG. 1), refrigerant in the suction chamber 131 is drawn into the associated cylinder bore 111 through the corresponding suction port 141 while flexing the suction valve flap 151. When each piston 24 moves from the bottom dead center to the top dead center (from the left side to the right side in FIG. 1), gaseous refrigerant in the corresponding cylinder bore 111 is discharged into the discharge chamber 132, which is a discharge pressure zone, through the corresponding discharge port 142 while flexing the discharge valve flap 161. The retainer plate 17 includes retainers 171, which correspond to the discharge valves 161. Each retainer 171 restricts the opening degree of the corresponding discharge valve flap 161.

An electromagnetic displacement control valve 26 is installed in the rear housing member 13. The displacement control valve 26 is positioned in a supply passage 27 that connects the discharge chamber 132 to the control pressure chamber 121. The opening degree of the valve 26 is adjusted by a pressure in the suction chamber 131 and a duty ratio when an electromagnetic solenoid (not shown) of the valve 26 is powered. When a valve hole of the valve 26 is closed, refrigerant in the discharge chamber 132 is not sent to the control pressure chamber 121.

The control pressure chamber 121 communicates with the suction chamber 131 through a bleed passage 28 and refrigerant in the control pressure chamber 121 flows out to the suction chamber 131 through bleed passage 28. When the valve opening of the displacement control valve 26 becomes greater, the greater amount of refrigerant flows from the discharge chamber 132 through the supply passage 27 to the control pressure chamber 121, which increases pressure in the control pressure chamber 121. As a result, the inclination of the swash plate 22 and thus displacement of the compressor 10 are decreased. When the valve opening of the displacement control valve 26 becomes smaller, the smaller amount of refrigerant flow from the discharge chamber 132 through the supply passage 27 to the control pressure chamber 121, which decreases a pressure in the control pressure chamber 121. As a result, the inclination of the swash plate 22 and thus displacement of the compressor 10 are increased.

Figure 2A:
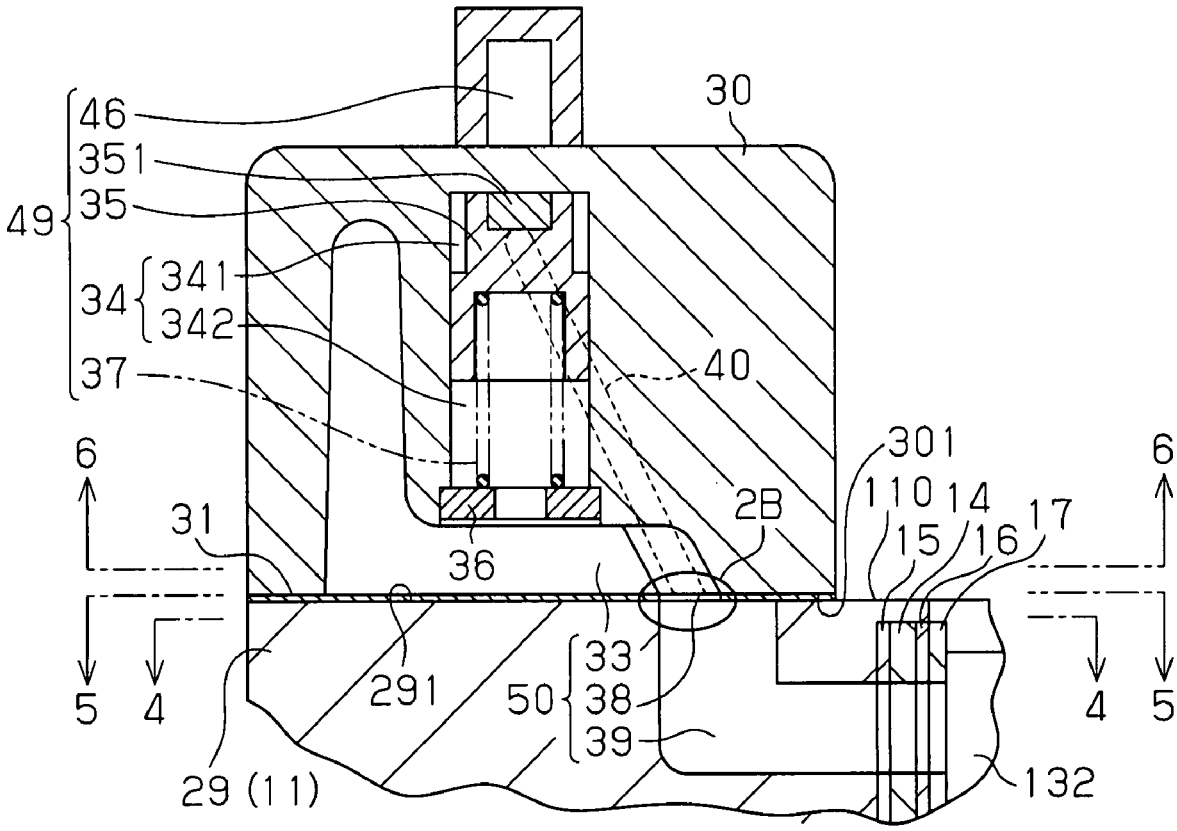
FIG. 2A is a partial enlarged cross-sectional side view of the structure of FIG. 1.
Figure 2B:
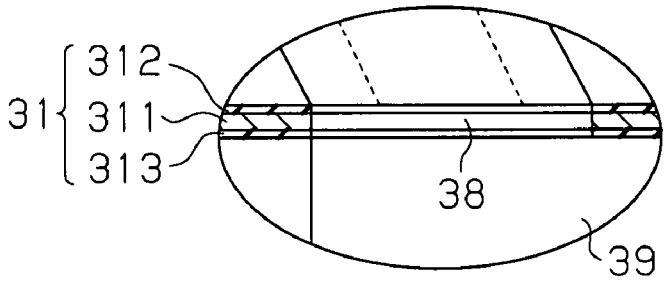
FIG. 2B is an enlarged view of the part encircled by the line 2B of FIG. 2A.
Figure 3A:
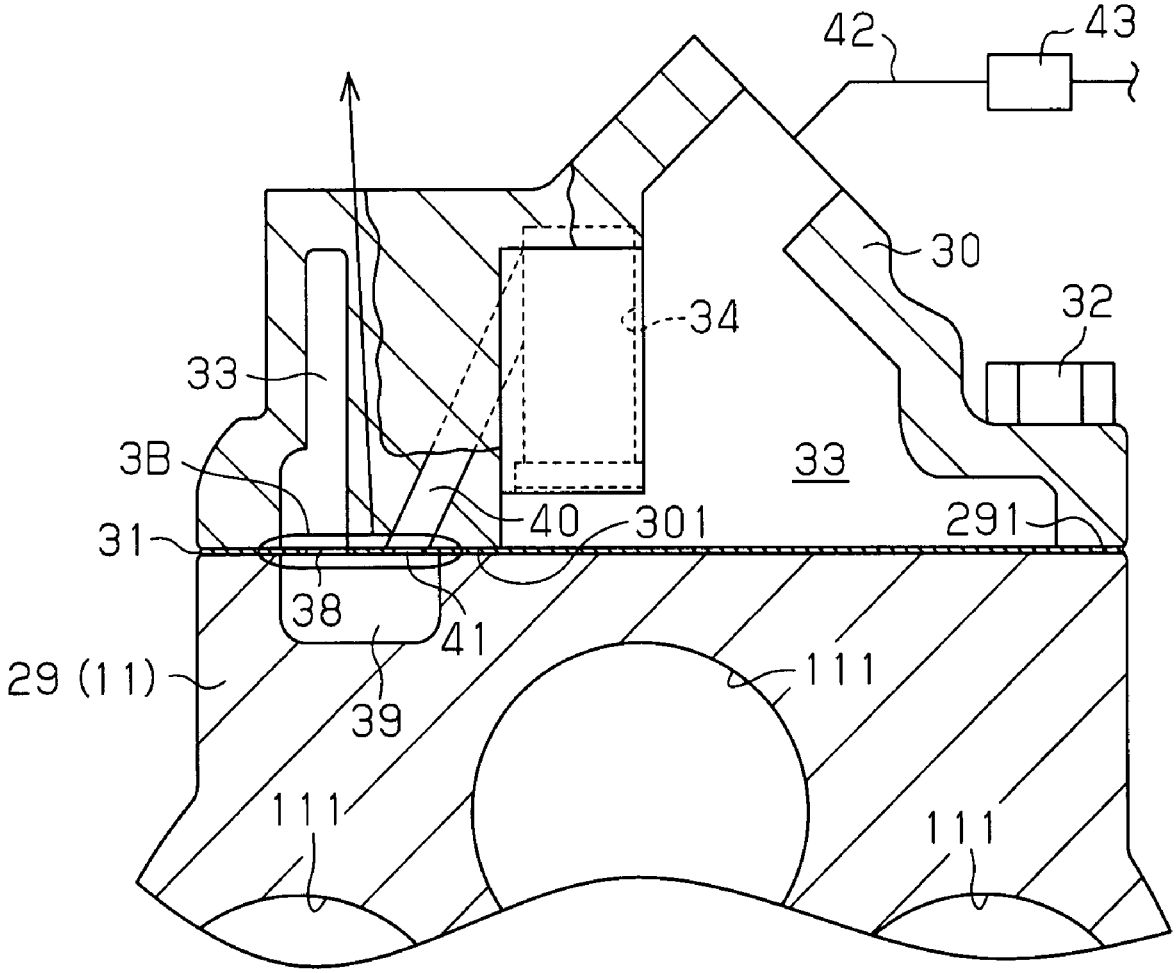
FIG. 3A is a cross-sectional view of FIG. 1 taken along the line 3A-3A.

A base 29 is integrally formed with the cylinder block 11, which is a part of an entire housing of the compressor, to protrude from the outer circumferential surface 110 of the cylinder block 11. As illustrated in FIG. 2A, an upper end 291 of the base 29, or an outer surface of the cylinder block 11 is flat. A muffler forming member 30 which serves as a passage forming member is attached to the upper end 291 with a sealing gasket 31. As illustrated in FIG. 2B, the gasket 31, serving as a partition plate, is formed by attaching rubber layers 312, 313 to both sides of the core metal plate 311 by heating. The gasket 31 prevents leakage of refrigerant from between the base 29 and the muffler forming member 30. As illustrated in FIG. 3A, the muffler forming member 30 and the gasket 31 are secured together with a screw 32.

As illustrated in FIG. 1 the muffler forming member 30 includes a muffler chamber 33 and a pressure introduction chamber 34. The pressure introduction chamber 34 accommodates a moving body 35. The moving body 35 divides the pressure introduction chamber 34 into a first pressure chamber 341 and a second pressure chamber 342. A compression spring 37 is positioned between the moving body 35 and a valve seat 36 in the form of ring. The compression spring 37 urges the moving body 35 from the second pressure chamber 342 toward the first pressure chamber 341. The second pressure chamber 342 communicates with the muffler chamber 33 through a center hole in the valve seat 36.

A permanent magnet 351 is attached to the moving body 35 and a magnetic detector 46 is provided on an outer surface of the muffler forming member 30. The magnetic detector 46 detects magnetic flux density of the permanent magnet 351. The magnetic flux density detected by the magnetic detector 46 is sent to a displacement control computer C1.

Figure 5:
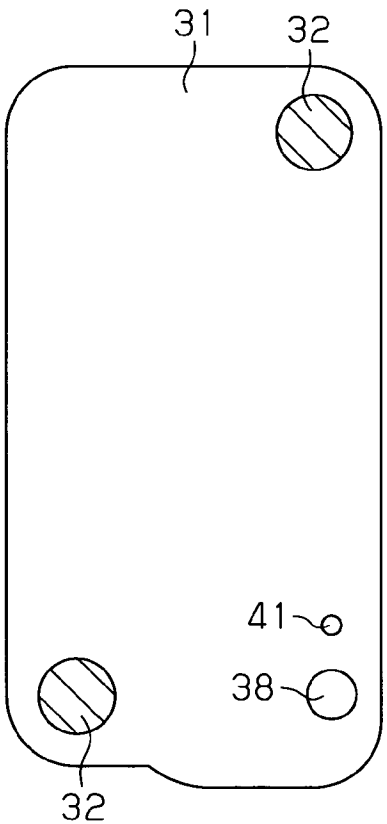
FIG. 5 is a cross-sectional view of FIG. 2A taken along the line 5-5.
Figure 4:
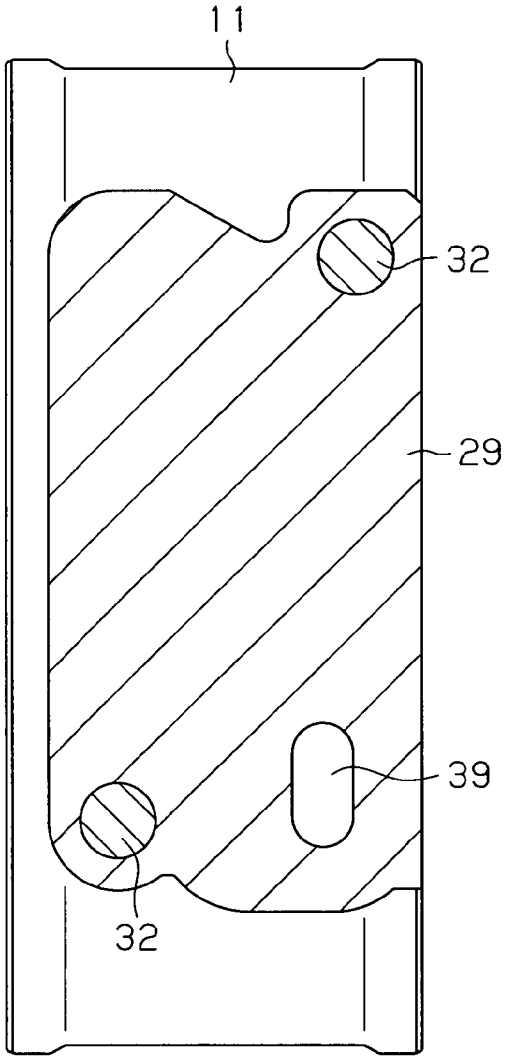
FIG. 4 is a cross-sectional view of FIG. 2A taken along the line 4-4.

An upstream passage 39 is formed in valve plate 14 and cylinder block 11 to connect with the discharge chamber 132. A restriction hole 38 is formed in the gasket 31 to penetrate the gasket 31 in the thickness direction of the gasket 31 so that the upstream passage 39 and the muffler chamber 33 are connected. FIG. 4 illustrates the upstream passage 39 formed in the cylinder block 11 and FIG. 5 illustrates the restriction hole 38 extending through the gasket 31.

As illustrated in FIG. 2A, the muffler chamber 33 is connected to the discharge chamber 132 through the restriction hole 38 and the upstream passage 39. A pressure introduction passage 40 extends in the muffler forming member 30 and penetrate the gasket 31. The first pressure chamber 341 communicates with the upstream passage 39 via the pressure introduction passage 40.

Figure 3B:
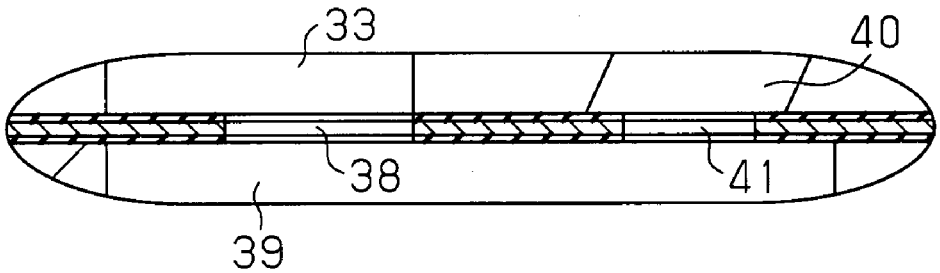
FIG. 3B is an enlarged view of the part encircled by the line 3B of FIG. 3A.
Figure 6:
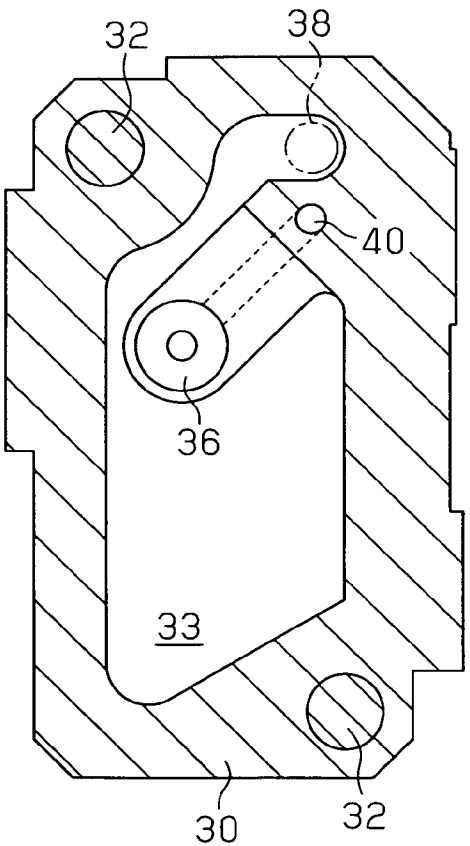
FIG. 6 is a cross-sectional view of FIG. 2A taken along the line 6-6 and FIG. 7 is a partial cross-sectional side view of a second embodiment of a structure for sensing flow rate of refrigerant.

As illustrated in FIGS. 3A and 3B, an opening 41, which is a part of the pressure introduction passage 40, extends through the gasket 31 in the thickness direction of the gasket 31. The flow passage area of the opening 41 is smaller than that of the pressure introduction passage 40 in the muffler forming member 30.

Refrigerant in the discharge chamber 132 flows through the upstream passage 39, the restriction hole 38, and the muffler chamber 33 to the external refrigerant circuit 42. The upstream passage 39, the restriction hole 38, and the muffler chamber 33 form a refrigerant passage 50 (as shown in FIG. 2A) of refrigerant that is discharged from inside the housing of the compressor 10 to outside the housing. The restriction hole 38 divides the refrigerant passage 50 into the upstream passage 39 and the muffler chamber 33 that is a downstream passage.

As illustrated in FIG. 1, refrigerant flowing out of the external refrigerant circuit 42 is returned to the suction chamber 131. A heat exchanger 43 for conducting heat away from refrigerant, an expansion valve 44, and a heat exchanger 45 for transferring ambient heat to refrigerant are positioned in the external refrigerant circuit 42. A thermal sensor for sensing temperature of refrigerant is positioned at the exit of the heat exchanger 45. The expansion valve 44 controls the flow rate of refrigerant depending on the change in temperature of the refrigerant.

The restriction hole 38 restricts the flow of the refrigerant that flows from the upstream passage 39 through the restriction hole 38 to the muffler chamber 33. This results in a pressure difference between a pressure in the upstream passage 39 and a pressure in the muffler chamber 33. The pressure in the muffler chamber 33 is lower than the pressure in the upstream passage 39.

As illustrated in FIG. 2A, pressure in the upstream passage 39 extends to the first pressure chamber 341 through the pressure introduction passage 40 and a pressure in the muffler chamber 33 extends to the second pressure chamber 342 through the central hole of the valve seat 36. A pressure in the first pressure chamber 341 and a pressure in the second pressure chamber 342 counteract via the moving body 35. A differential pressure between the pressure in the first pressure chamber 341 (or the pressure in the upstream passage 39) and the pressure in the second pressure chamber 342 (or the pressure in the muffler chamber 33) acts against a spring force by the compression spring 37 so that the moving body 35 is placed in a position at which the differential pressure and the spring force are balanced.

When the flow rate of refrigerant that flows through the upstream passage 39, the restriction hole 38, and the muffler chamber 33 is increased, the differential pressure becomes greater. Thus, the moving body 35 moves in a direction from the first pressure chamber 341 to the second pressure chamber 342. When the flow rate of refrigerant that flows through the upstream passage 39, the restriction hole 38, and the muffler chamber 33 is decreased, the differential pressure becomes smaller. Thus, the moving body 35 moves in a direction from the second pressure chamber 342 to the first pressure chamber 341. The magnetic flux density detected by the magnetic detector 46 reflect the location of the moving body 35, and thus, the flow rate of discharged refrigerant that flows through the upstream passage 39, the restriction hole 38, and the muffler chamber 33.

The pressure introduction chamber 34, the moving body 35, the compression spring 37, and the magnetic detector 46 form the differential pressure-type flow rate sensor 49. FIG. 2A that picks up a pressure in the upstream passage 39 and a pressure in the muffler chamber 33 serving as a downstream passage to detect the flow rate of refrigerant in the refrigerant passage 50. The pressure introduction passage 40 in the muffler forming member 30 has a linear shape and extends from a surface 301 of muffler forming member 30 facing to the base 29 (or the cylinder block 11) to the sensor 49, as shown in FIGS. 2A and 3A.

As illustrated in FIG. 1, the displacement control computer C is connected to a compartment temperature setting device 47 and a compartment temperature detector 48. The displacement control computer C1 controls the current supplied to the electromagnetic solenoid so that the temperature detected by the compartment temperature detector 48 is converged to a target temperature set by the compartment temperature setting device 47 based on the information on the magnetic flux density obtained from the magnetic detector 46. In other words, the displacement control computer C1 feedback-controls the flow rate of discharged refrigerant to an appropriate flow rate based on the information on the magnetic flux density obtained from the magnetic detector 46.

The displacement control computer C1 transmits the torque data of the compressor 10 that are measured based on the information on the magnetic flux density to a engine control computer C2. The engine control computer C2, based on the torque data, controls the speed of the engine to an appropriate value.

The present embodiment has the following advantages.

The restriction hole 38 is provided in the planar gasket 31 to extend through the gasket 31. This facilitates formation of the restriction hole 38 by pressing. Thus, the restriction hole 38 that has a desired size corresponding to the flow passage area can be formed with high accuracy. If a gasket 31 having a thickness that corresponds to a desired length of the restriction hole 38 is used, the resultant hole 38 should have the desired length. In this regard, the restriction hole 38 may also be formed with high accuracy.

The smaller the flow passage area of the pressure introduction passage 40 for introducing pressure into the upstream passage 39 to the first pressure chamber 341, the less the effect that hydrodynamic pressure from the discharged refrigerant flowing in the upstream passage 39 will have on the flow rate sensor 49. The configuration that the opening 41, which is a part of the pressure introduction passage 40, is provided in the gasket 31 is advantageous in making the flow passage area of the opening 41 small.

If the pressure introduction passage is formed by forming a space in a structure by die molding and then forming a pressure introduction passage by extending the passage from the space with a drill, the volume of the muffler chamber 33 will be limited by the space. Meanwhile, when the pressure introduction passage 40 is formed in the muffler forming member 30 in the form of a straight passage, the pressure introduction passage 40 may be readily formed by drilling the muffler forming member 30 from the bottom side and no such space is required. Therefore, the volume of the muffler chamber 33 may be made greater.

The gasket 31 is suitable for easily providing the restriction hole 38 and the opening 41.

Pressure in the muffler chamber 33 is introduced into the second pressure chamber 342, which is open to the muffler chamber 33. The structure that connects the muffler chamber 33 with the second pressure chamber 342 is simple. The fact that the muffler chamber 33 is a downstream passage of the refrigerant passage 50 facilitates introduction of the pressure in the downstream passage to the sensor 49.

The gasket includes a metal plate 311 as a core member. This is advantageous in improving accuracy of pressing the hole.

Figure 7:
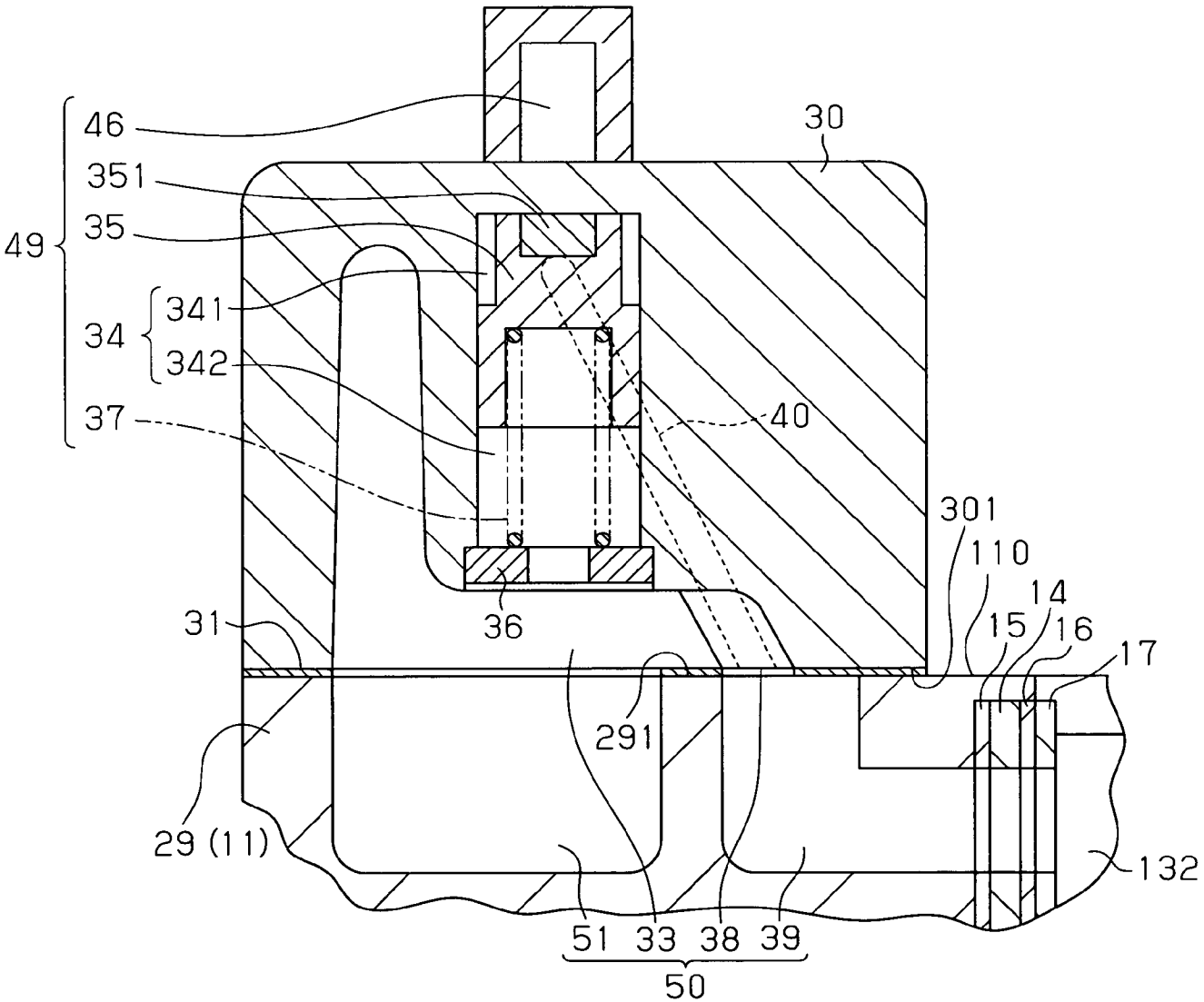

Referring to FIG. 7, a second embodiment is described. In the second embodiment, like reference numerals refer to like elements.

In the second embodiment, the muffler chamber 51 is recessed in the base 29 (or cylinder block 11) so as to communicate with the muffler chamber 33. The muffler chamber 51 is a part of the downstream passage and contributes to improvement in noise reduction by increasing the volume of the entire muffler chamber 51.

The invention may be embodied in the following forms.

The passage forming member may be provided between the external refrigerant circuit 42 and the suction chamber 131. In such a case, a differential pressure-type flow rate sensor 49 in the passage forming member senses the flow rate of refrigerant that flows from the external refrigerant circuit 42 into the suction chamber 131.

The first pressure chamber 341 and the second pressure chamber 342 in the sensor 49 may be interchanged.

The moving body 35 in the sensor 49 may be a bellows or a diaphragm.

A seal ring may be placed between the base 29 and the muffler forming member 30 to seal around the restriction hole 38 of the partition plate.

A seal ring may be placed between the base 29 and the muffler forming member 30 to seal around the opening 41 of the partition plate.

The muffler forming member 30 may be attached to the outer circumferential surface of the front housing 12 or that of the rear housing 13 instead of the outer circumferential surface of the cylinder block 11. Alternatively, the muffler forming member 30 may be attached to two or more of the cylinder block 11, the front housing 12, and the rear housing 13.

The gasket 31 may be formed by attaching resin layers to both sides of the metal plate 311.

The present examples and embodiments are to be considered as illustrative and not restrictive and the invention is not to be limited to the details given herein, but may be modified within the scope and equivalence of the appended claims.

What is claimed is:

1. A structure for sensing refrigerant flow rate in a compressor, the compressor including a housing connected to an external refrigerant circuit via a refrigerant passage, the structure comprising:

a passage forming member connected to an outer surface of the housing, wherein the passage forming member forms a part of the refrigerant passage;

a restriction hole for dividing the refrigerant passage into an upstream passage and a downstream passage, the upstream passage being formed in either the housing or the passage forming member;

a differential pressure-type flow rate sensor provided in the passage forming member, wherein the sensor picks up a pressure in the upstream passage and a pressure in the downstream passage to sense flow rate of refrigerant in the refrigerant passage; and a partition plate disposed between the housing and the passage forming member, wherein the restriction hole is formed in the partition plate to extend through the partition plate.

2. The structure according to claim 1, wherein the passage forming member forms a part of the refrigerant passage of the refrigerant that is discharged from inside the housing to the outside of the housing, wherein the upstream passage is formed in the housing and the downstream passage is formed in the passage forming member.

3. The structure according to claim 2, further comprising a pressure introduction passage for introducing the pressure in the upstream passage into the sensor, wherein the pressure introduction passage is formed to extend through the partition plate.

4. The structure according to claim 3, wherein the pressure introduction passage is a linear passage extending from the sensor to the partition plate.

5. The structure according to claim 2, wherein the downstream passage comprises a muffler chamber.

6. The structure according to claim 2, wherein the partition plate comprises a gasket.

7. The structure according to claim 1, wherein the compressor is a variable displacement compressor for controlling displacement by adjusting a pressure in a control pressure chamber, the refrigerant circuit includes a discharge pressure zone and a suction pressure zone, the compressor includes a supply passage for connecting the control pressure chamber to the discharge pressure zone and a bleed passage for connecting the suction pressure zone to the control pressure chamber, and the pressure in the control pressure chamber is adjusted by supplying refrigerant in discharge pressure zone to the control pressure chamber via the supply passage and releasing refrigerant in the control pressure chamber into the suction pressure zone via the bleed passage.

8. The structure according to claim 3, wherein the sensor includes:

a pressure introduction chamber formed in the passage forming member;

a moving body for dividing the pressure introduction chamber into a first pressure chamber and a second pressure chamber, wherein the moving body includes a permanent magnet, wherein the first pressure chamber is connected to the upstream passage through the pressure introduction passage and the second pressure chamber is connected to the downstream passage;

a compression spring for urging the moving body from the second pressure chamber to first pressure chamber; and a magnetic detector for detecting magnetic flux density of the permanent magnet, the detector being disposed outside the passage forming member, wherein the magnetic flux density reflects a location of the moving body determined by the differential pressure.

* * * * *